US009946149B1

(12) United States Patent
Pao

(10) Patent No.: US 9,946,149 B1
(45) Date of Patent: Apr. 17, 2018

(54) METHOD OF PRODUCING A PACKAGING MATERIAL FOR MAKING A PACKAGING BAG CONFIGURED TO CONTAIN HAIR DYE

(71) Applicant: DONG AN BIO-TECH CO., LTD., Taichung (TW)

(72) Inventor: Cheng-Li Pao, Taichung (TW)

(73) Assignee: DONG AN BIO-TECH CO., LTD., Taichung (TW)

( * ) Notice: Subject to any disclaimer, the term of this patent is extended or adjusted under 35 U.S.C. 154(b) by 0 days.

(21) Appl. No.: 15/616,244

(22) Filed: Jun. 7, 2017

(51) Int. Cl.

| | |
|---|---|
| ***A45D 34/00*** | (2006.01) |
| ***G03D 15/06*** | (2006.01) |
| ***G03D 15/04*** | (2006.01) |
| ***B65D 33/22*** | (2006.01) |
| *B65D 33/01* | (2006.01) |
| *B65D 33/00* | (2006.01) |

(52) U.S. Cl.
CPC ..... *G03D 15/06* (2013.01); *A45D 34/00* (2013.01); *B65D 33/22* (2013.01); *G03D 15/04* (2013.01); *B65D 33/00* (2013.01); *B65D 33/01* (2013.01); *B65D 2251/20* (2013.01)

(58) Field of Classification Search
CPC . B32B 37/06; B32B 37/1207; B32B 37/1284; B29C 65/02; B29C 65/18
See application file for complete search history.

(56) References Cited

PUBLICATIONS

Human translation of CN 104097366 A; Date: Jul. 15, 2014.*

* cited by examiner

*Primary Examiner* — Vishal I Patel
(74) *Attorney, Agent, or Firm* — Michael Best & Friedrich LLP

(57) ABSTRACT

A method of producing a packaging material for making a packaging bag configured to contain hair dye includes the steps of preparing a first biaxially-oriented polyester film and an aluminum foil film, coating them with adhesives, and hot pressing them; preparing a second biaxially-oriented polyester film and roughening opposite surfaces thereof; coating one surface of the second biaxially-oriented polyester film with an adhesive, adhere it to the aluminum foil film and hot pressing them; preparing a cast polypropylene film and coating a surface thereof with an adhesive; and adhering the surface of the cast polypropylene film to the other surface of the second biaxially-oriented polyester film and hot pressing them.

10 Claims, 5 Drawing Sheets

METHOD OF PRODUCING A PACKAGING MATERIAL FOR MAKING A PACKAGING BAG CONFIGURED TO CONTAIN HAIR DYE

FIELD

The disclosure relates to a method of producing a packaging material for making a packaging bag configured to contain hair dye.

BACKGROUND

Hair dye contains an ingredient that is corrosive, so that a bottle or can is used in the past for packaging the hair dye. However, the bottle or can is usually filled with a large amount of hair dye which can be used for dozens of times. After the bottle or can is opened and used, the next time to use it again may take several days, and it may be difficult to completely seal the bottle or can, so that oxidation and deterioration of the hair dye may easily occur. Hence, this kind of packaging for hair dye is inappropriate.

In order to resolve the aforesaid drawback, the applicant has developed a packaging material for a packaging bag which is used to contain hair dye for one-time use only and a method of producing the same, which are both disclosed in Taiwanese Patent No. I569958. The method mainly includes adhering a polyester film (PET film), an aluminum foil film, a vacuum plating polyester film (V.P. PET film) and a polypropylene (CPP) film in sequence and in stages by adhesives, hot pressing them together, and allowing them to stand for some time so as to form the aforesaid packaging material. Although the aforesaid method can achieve its intended purpose, it still has the following disadvantages:

1) During adhesion and hot pressing stages of the four films, occurrence of warping and deformation still exist, and following the increase of the hot pressing temperature, the deformation is more evident. The heating temperature is reduced from 50 to 46 degrees Celsius to minimize the warpage phenomenon. However, this method cannot completely overcome the problem of warpage, so that the material cost is increased and the packaging operation is complicated.

2) Further, by conducting some tests, it was found that the PET film and the V.P. PET film have a high degree of smoothness which can reduce the adhesion force of the aluminum foil film and the PP film thereto, so that the films must be heated to force further adhesion of the films. This may be the reason why the hot press temperature should be set at least 50 degrees Celsius.

3) Apart from causing warping and deformation by hot pressing, after the four films are adhered by hot pressing, if the films are exposed to a normal ambient temperature, a phenomenon of heat shrinkage deformation may occur. By allowing the adhered films to stand still in a 30 degrees Celsius environment for 48 hours, there still exists poor adhesion and warpage phenomenon.

SUMMARY

Therefore, an object of the present disclosure is to provide a method of producing a packaging material for making a packaging bag configured to contain hair dye that can alleviate at least one of the drawbacks of the prior arts.

According to this disclosure, a method of producing a packaging material for making a packaging bag configured to contain hair dye comprises the steps of:

A) preparing a first biaxially-oriented polyester film having a thickness ranging from 6 μm to 24 μm and an aluminum foil film having a thickness ranging from 4 μm to 15 μm;

(B) roughening a first surface of the first biaxially-oriented polyester film so that the first surface has a surface roughness greater than that of a second surface of the first biaxially-oriented polyester film which is opposite to the first surface;

(C) coating the first surface of the first biaxially-oriented polyester film and the aluminum foil film with adhesives, adhering the first surface of the first biaxially-oriented polyester film and the aluminum foil film to each other, and hot pressing them at a temperature of about 36 to 44 degrees Celsius to stick them together;

(D) preparing a second biaxially-oriented polyester film having a thickness ranging from 6 μm to 24 μm and roughening opposite first and second surfaces of the second biaxially-oriented polyester film;

(E) coating one of the first and second surfaces of the second biaxially-oriented polyester film with an adhesive, adhering the one of the first and second surfaces of the second biaxially-oriented polyester film to the aluminum foil film opposite to the first surface of the first biaxially-oriented polyester film, and hot pressing them at a temperature of about 36 to 44 degrees Celsius;

(F) preparing a cast polypropylene film having a thickness ranging from 20 μm to 60 μm and coating a surface of the cast polypropylene film with an adhesive; and (G) adhering the surface of the cast polypropylene film to the other one of the first and second surfaces of the second biaxially-oriented polyester film and hot pressing them at a temperature of about 36 to 44 degrees Celsius, thereby forming the packaging material.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
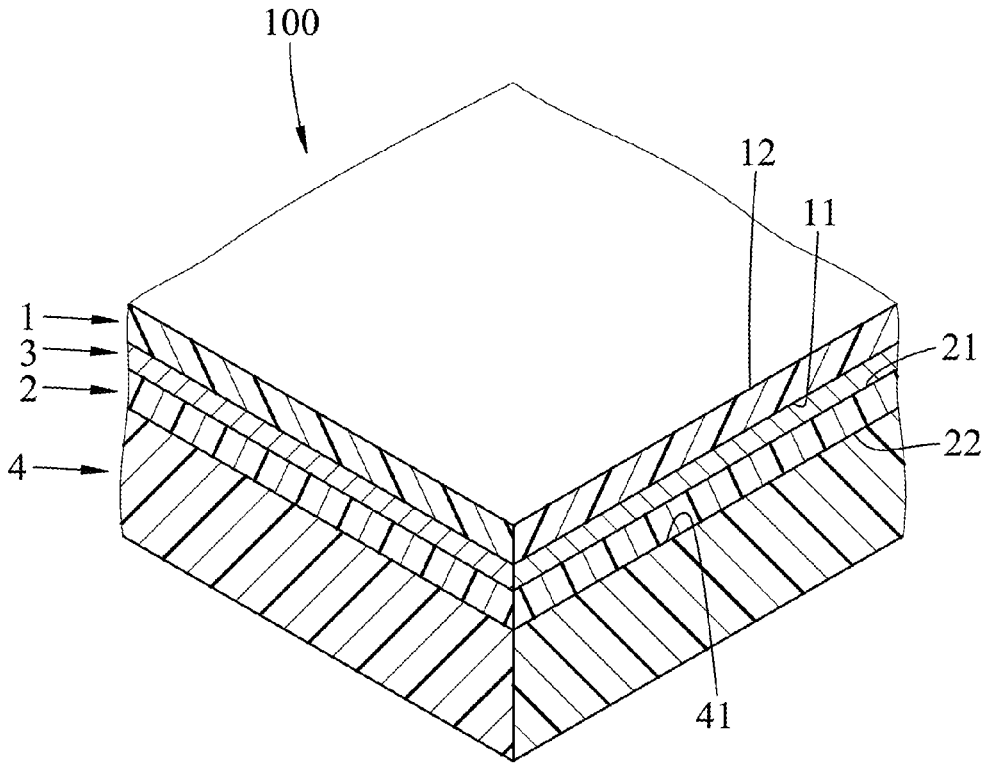
FIG. 1 is a fragmentary sectional view of a packaging material produced from a method according to the embodiment of the present disclosure.

Referring to FIG. 1, a method of producing a packaging material according to the embodiment of the present invention includes the below steps.

Step one: A first biaxially-oriented polyester (boPET) film 1 and a second biaxially-oriented polyester (boPET) film 2 each of which has a thickness ranging from 6 μm to 24 μm, an aluminum foil film 3 having a thickness ranging from 4 μm to 15 μm, and a cast polypropylene (CPP) film 4 having a thickness ranging from 20 μm to 60 μm are prepared.

Step two: A first surface 11 of the first boPET film 1 and opposite first and second surfaces 21, 22 of the second boPET film 2 are roughened, and a second surface 12 of the first biaxially-oriented polyester film 1, which is opposite to the first surface 11 thereof and which is untreaded, is printed with a packaging pattern. Each of the treated first surface 11 of the first boPET film 1 and the first and second surfaces 21, 22 of the second boPET film 2 has an arithmetical mean deviation of the profile (Ra) of between 0.12 and 0.4 μm, while the untreated second surface 12 of the first boPET film 1 has an arithmetical mean deviation of the profile (Ra) of between 0.08 and 0.16 μm which is suitable for ink printing.

Step three: The first surface 11 of the first boPET film 1 and the aluminum foil film 3 are coated with adhesives, after which they are adhered to each other and are hot pressed at a temperature of about 36 to 44 degrees Celsius to stick them together. It is preferable that the adhesion and curing be controlled at a constant temperature of 40 degrees Celsius. A bilayer film is formed at this time.

Step four: The first surface 21 of the second boPET film 2 is first coated with an adhesive, after which it is adhered to the aluminum foil film 3 of the bilayer film opposite to the first surface 11. They are then hot pressed at a temperature of about 36 to 44 degrees Celsius. It is preferable that the adhesion and curing be controlled at a constant temperature of 40 degrees Celsius. A three-layer film is formed at this time.

Step five: A surface 41 of the CPP film 4 is coated with an adhesive, after which it is adhered to the second surface 22 of the second boPET film 2 of the three-layer film. They are then hot pressed at a temperature of about 36 to 44 degrees Celsius. It is preferable that the adhesion and curing be controlled at a constant temperature of 40 degrees Celsius. A packaging material 100 having a four-layer film is finally formed at this time.

It is worth to mention herein that, after the packaging material 100 having the four-layer film is completed, the packaging material 100 is placed in a specific temperature storage (not shown) for allowing the packaging material 100 to stand still and fix the shape thereof. It is preferable that the temperature of the specific temperature storage is controlled at about 36 to 44 degrees Celsius, and the packaging material 100 is placed in the specific temperature storage for about 96 hours. The temperature of the specific temperature storage may be similar to that of the foregoing hot pressing process, or may differ from that of the foregoing hot pressing process by no more than one degree Celsius.

According to the aforesaid hot pressing temperature setting, the temperature of the specific temperature storage is best controlled between 39 and 41 degrees Celsius. Further, the hot pressing temperature of the first boPET film 1 and the aluminum foil film 3, the hot pressing temperature of the second boPET film 2 and the aluminum foil film 3, and the hot pressing temperature of the CPP film 4 and the second boPET film 2 are all controlled at about 39 to 41 degrees Celsius, but may also be controlled to differ from each other by no more than one degree Celsius, or be controlled at a constant temperature of 40 degree Celsius. As such, deformation of the packaging material 100 after forming is not likely to occur.

Figure 2:
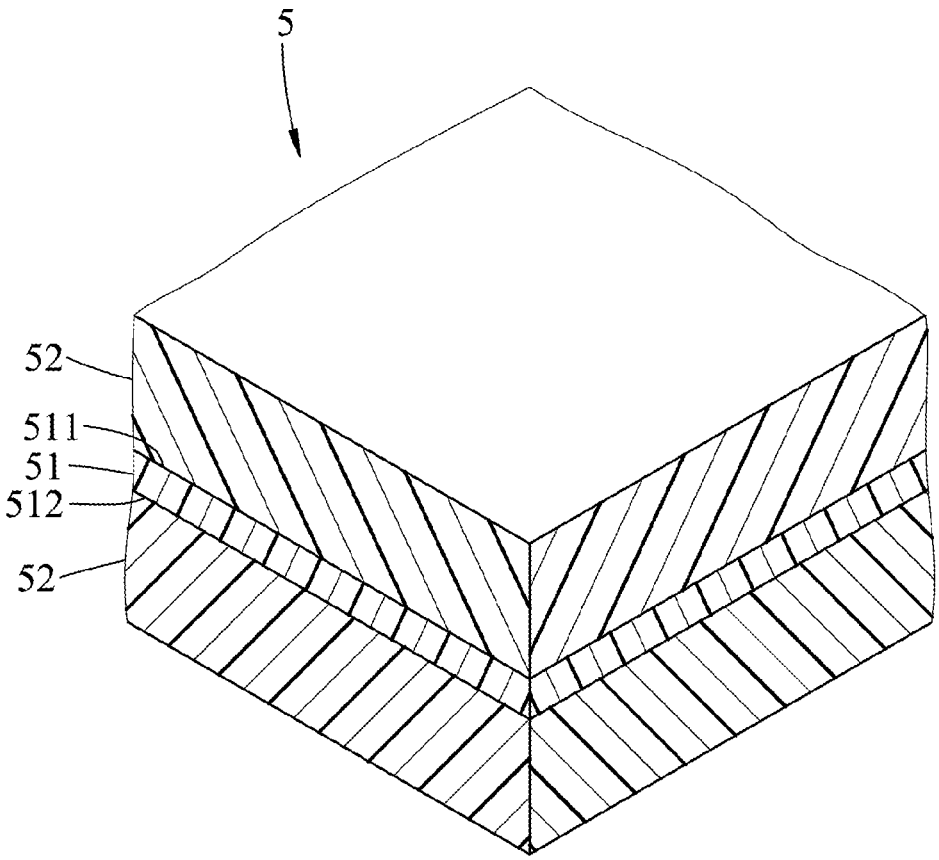
FIG. 2 is a sectional view of a spacer material of the embodiment.

Apart from using the aforesaid packaging material 100 to make a packaging bag, a spacer material 5, as shown in FIG. 2, may be further prepared to cooperate with the packaging material 100 to produce a packaging bag having a plurality of pockets. The spacer material 5 includes a spacer biaxially-oriented polyester (boPET) film 51 having a thickness ranging from 6 μm to 24 μm, and two spacer cast polypropylene (CPP) films 52 each of which has a thickness ranging from 20 μm to 60 μm. Two opposite surfaces 511, 512 of the spacer boPET film 51 are first roughened and coated with adhesives, after which the surfaces 511, 512 are respectively adhered to the spacer CPP films 52 and are hot pressed to thereby form the spacer material 5. In an alternative embodiment, each spacer biaxially-oriented polyester (boPET) film 51 may be replaced by a spacer aluminum foil film (not shown).

Figure 3:
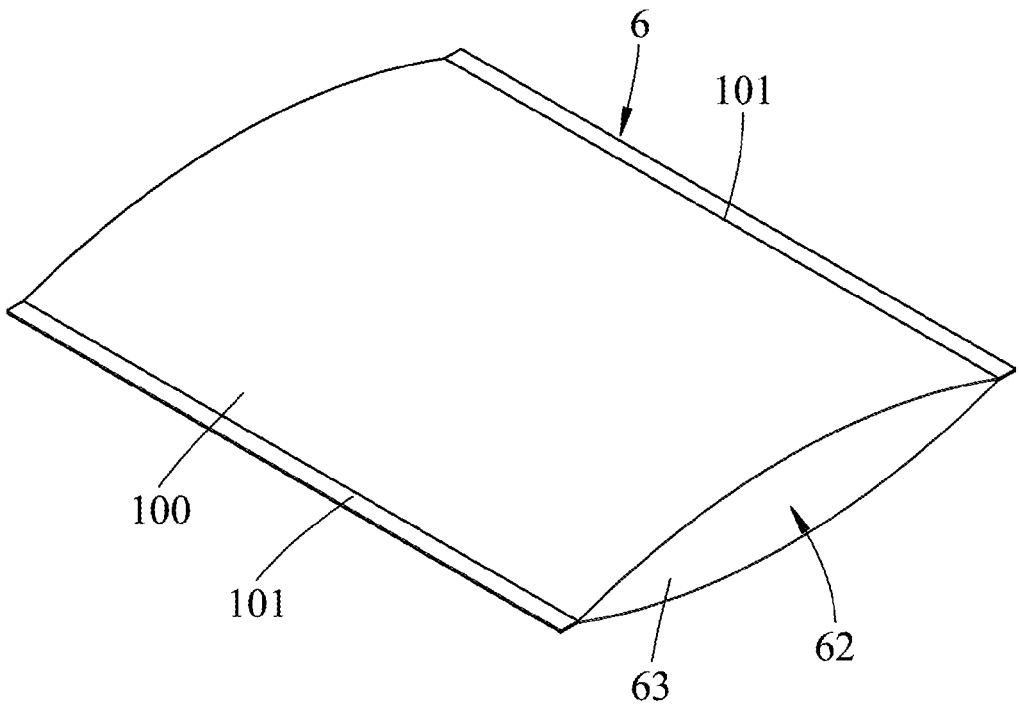
FIG. 3 is a perspective view of a packaging bag made from the packaging material of the embodiment.

Referring to FIG. 3, a packaging bag 6 made from the packaging material 100, which is produced from the method of this disclosure, is obtained by first cutting the packaging material 100 to a predetermined size, followed by folding the cut packaging material 100 into half, and finally, instantaneously heat sealing two lateral sides 101 of the folded packaging material 100, which are opposite to each other along a first direction, at a temperature of 120 to 130 degrees Celsius, thereby forming the packaging bag 6. The packaging bag 6 defines a chamber 62 configured to contain hair dye, and has an open end 63 communicating with the chamber 62. After the hair dye is filled into the chamber 62 via the open end 63, the open end 63 is then instantaneously heat sealed at a temperature of about 120 to 130 degrees Celsius so as to seal the hair dye in the chamber 62 of the packaging bag 6.

Figure 4:
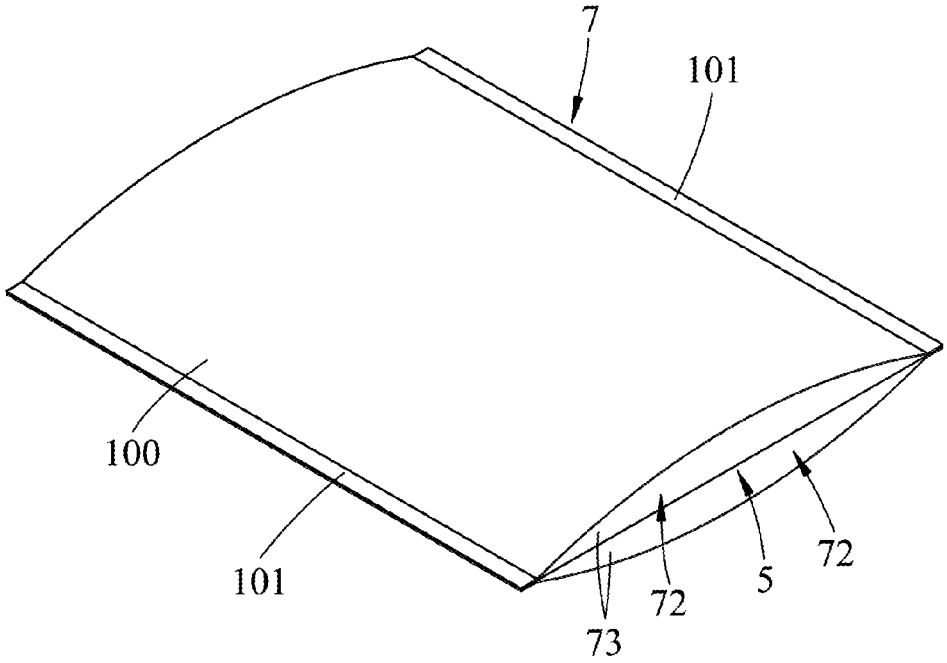
FIG. 4 is a perspective view of another packaging bag made from the packaging material of the embodiment in cooperation with the spacer material.

Referring to FIG. 4, a packaging bag 7 made from the packaging material 100, which is produced from the method of this disclosure, is obtained by first cutting the packaging material 100 to a predetermined size, followed by folding the cut packaging material 100 into half and inserting the spacer material 5 therebetween, and finally, instantaneously heat sealing two lateral sides 101 of the folded packaging material 100, which are opposite to each other along a first direction, at a temperature of 120 to 130 degrees Celsius, thereby forming the packaging bag 7. The packaging bag 7 defines two chambers 72 spaced apart from each other along a second direction transverse to the first direction and configured to contain hair dyes, and has two open ends 73 respectively communicating with the chambers 72. After the hair dye is filled into each chamber 72 via the respective open end 73, the open ends 73 are then instantaneously heat sealed at a temperature of about 120 to 130 degrees Celsius so as to seal the hair dyes in the respective chambers 72 of the packaging bag 7.

Figure 5:
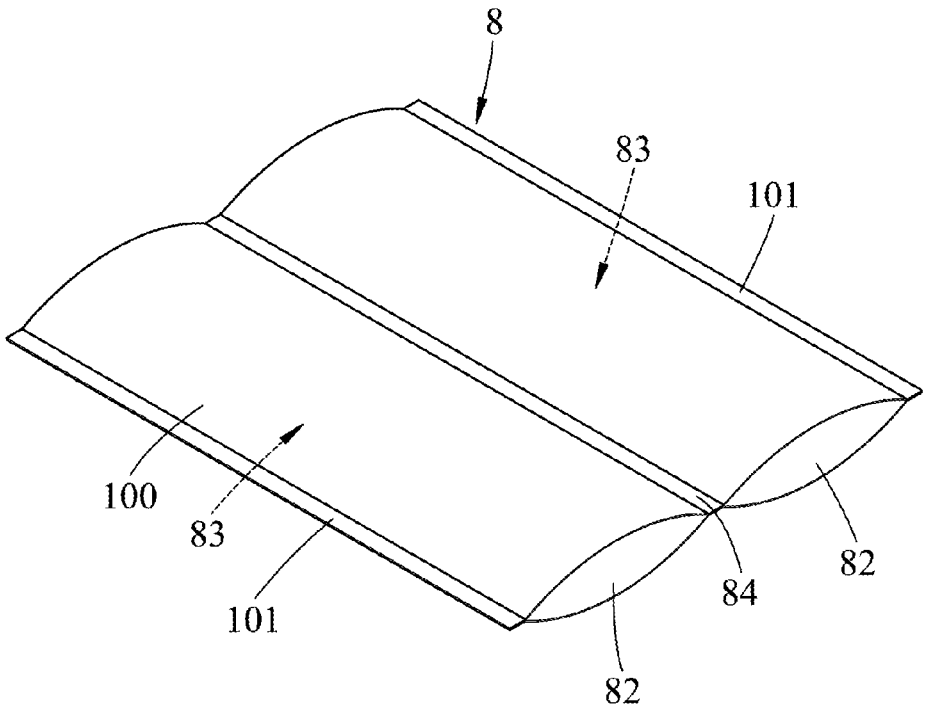
FIG. 5 is a perspective view of yet another packaging bag made from the packaging material of the embodiment.

Referring to FIG. 5, a packaging bag 8 made from the packaging material 100, which is produced from the method of this disclosure, is obtained by first cutting the packaging material 100 to a predetermined size, followed by folding the cut packaging material 100 into half and instantaneously heat sealing two lateral sides 101 of the folded packaging material 100, which are opposite to each other along a first direction, at a temperature of 120 to 130 degrees Celsius. Finally, a central portion of the folded packaging material 100 is heat-sealed to form a partition 84 parallel to the lateral sides 101 of the folded packaging material 100. Thus, the obtained packaging bag 8 defines two chambers 83 spaced apart from each other along the first direction and configured to contain hair dyes, and has two open ends 82 respectively communicating with the chambers 83. After the hair dye is filled into each chamber 83 via the respective open end 82, each open end 82 is then instantaneously heat sealed at a temperature of about 120 to 130 degrees Celsius so as to seal the hair dye in each chamber 83 of the packaging bag 8.

It is worth to mention herein that the aforementioned predetermined size refers to a size having a space that can accommodate a one-time use of the hair dye, usually about 5 to 30 cm3.

In sum, by controlling the temperature of the multiple hot pressing processes at about 36 to 44 degrees Celsius, the occurrence of warping of each film during the multiple hot pressing processes can be minimized, thereby ensuring that the packaging bag 6, 7, 8 made from the packaging material 100 produced from the method of this disclosure has a good defect-free rate after containing the hair dye. Moreover, by placing the packaging material 100 in the specific temperature storage of about 36 to 44 degrees Celsius after hot pressing, the shape of the packaging material 100 can be further ensured to be fixed without warping and deforming. Therefore, the object of this disclosure can indeed be realized.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method of producing a packaging material for making a packaging bag configured to contain hair dye, comprising the steps of:

(A) preparing a first biaxially-oriented polyester film having a thickness ranging from 6 μm to 24 μm and an aluminum foil film having a thickness ranging from 4 μm to 15 μm;

(B) roughening a first surface of the first biaxially-oriented polyester film so that the first surface has a surface roughness greater than that of a second surface of the first biaxially-oriented polyester film which is opposite to the first surface;

(C) coating the first surface of the first biaxially-oriented polyester film and the aluminum foil film with adhesives, adhering the first surface of the first biaxially-oriented polyester film and the aluminum foil film to each other, and hot pressing them at a temperature of about 36 to 44 degrees Celsius;

(D) preparing a second biaxially-oriented polyester film having a thickness ranging from 6 μm to 24 μm and roughening opposite first and second surfaces of the second biaxially-oriented polyester film;

(E) coating one of the first and second surfaces of the second biaxially-oriented polyester film with an adhesive, adhering the one of the first and second surfaces of the second biaxially-oriented polyester film to the aluminum foil film opposite to the first surface of the first biaxially-oriented polyester film, and hot pressing them at a temperature of about 36 to 44 degrees Celsius;

(F) preparing a cast polypropylene film having a thickness ranging from 20 μm to 60 μm and coating a surface of the cast polypropylene film with an adhesive; and (G) adhering the surface of the cast polypropylene film to the other one of the first and second surfaces of the second biaxially-oriented polyester film and hot pressing them at a temperature of about 36 to 44 degrees Celsius to stick them together, thereby forming the packaging material.

2. The method as claimed in claim 1, wherein a step of printing the second surface of the first biaxially-oriented polyester film with a packaging pattern is performed after step (B) and prior to step (C).

3. The method as claimed in claim 1, wherein the hot pressing temperature of the first biaxially-oriented polyester film and the aluminum foil film, the hot pressing temperature of the second biaxially-oriented polyester film and the aluminum foil film, and the hot pressing temperature of the cast polypropylene film and the second biaxially-oriented polyester film are all controlled at about 39 to 41 degrees Celsius.

4. The method as claimed in claim 3, wherein the hot pressing temperature of the first biaxially-oriented polyester film and the aluminum foil film, the hot pressing temperature of the second biaxially-oriented polyester film and the aluminum foil film, and the hot pressing temperature of the cast polypropylene film and the second biaxially-oriented polyester film are controlled to differ from each other by no more than one degree Celsius.

5. The method as claimed in claim 1, further comprising a step of placing the packaging material in a specific temperature storage to stand still for 96 hours after step (G), the temperature of the specific temperature storage being controlled at about 36 to 44 degrees Celsius.

6. The method as claimed in claim 1, further comprising steps (H), (I) and (J) after step (G), wherein in step (H), a spacer biaxially-oriented polyester film having a thickness ranging from 6 μm to 24 μm and two spacer cast polypropylene films each of which has a thickness ranging from 20 μm to 60 μm are prepared; wherein in step (I), two opposite surfaces of the spacer biaxially-oriented polyester film are roughened and are coated with adhesives; and wherein in step-(J), the two opposite surfaces of the spacer biaxially-oriented polyester film are respectively adhered to the two spacer cast polypropylene films and are then hot pressed to thereby form a spacer material.

7. The method as claimed in claim 1, further comprising a step of cutting the packaging material to a predetermined size after step (G), followed by folding the cut packaging material into half.

8. The method as claimed in claim 7, further comprising a step of heat sealing two lateral sides of the folded packaging material, which are opposite to each other along a first direction, at a temperature of about 120 to 130 degrees Celsius, thereby forming a packaging bag that defines a chamber configured to contain hair dye and that has an open end communicating with the chamber.

9. The method as claimed in claim 8, further comprising a step of heat sealing a central portion of the folded packaging material to form a partition parallel to the two lateral sides of the folded packaging material, thereby forming a packaging bag that defines two chambers spaced apart from each other along the first direction and configured to contain hair dyes and that has two open ends respectively communicating with the two chambers.

10. The method as claimed in claim 6, further comprising a step of cutting the packaging material to a predetermined size after step (G), followed by folding the cut packaging material into half and inserting the spacer material therebetween, and heat sealing two lateral sides of the folded packaging material, which are opposite to each other along a first direction, at a temperature of about 120 to 130 degrees Celsius, thereby forming a packaging bag that defines two chambers spaced apart from each other along a second direction transverse to the first direction and configured to contain hair dyes and that has two open ends respectively communicating with the two chambers.

* * * * *